US006202847B1

(12) United States Patent
Hardy et al.

(10) Patent No.: US 6,202,847 B1
(45) Date of Patent: Mar. 20, 2001

(54) STACKABLE BOXES

(75) Inventors: Christopher Hardy; Jason Walsh, both of Springfield, IL (US)

(73) Assignee: Design Ideas, Ltd., Springfield, IL (US)

( * ) Notice: Subject to any disclaimer, the term of this patent is extended or adjusted under 35 U.S.C. 154(b) by 0 days.

(21) Appl. No.: 09/233,244

(22) Filed: Jan. 19, 1999

(51) Int. Cl.[7] ..... B65D 21/032
(52) U.S. Cl. ..... 206/509; 206/510
(58) Field of Search ..... 206/509, 510, 206/511; 217/65, 40, 42, 13; 220/4.28, 4.34

(56) References Cited

U.S. PATENT DOCUMENTS 3,572,577 * 3/1971 Dorfman ..... 206/509
3,591,212 * 7/1971 Rhyne ..... 217/65
4,173,287 * 11/1979 Kumakawa ..... 217/65
5,060,819 * 10/1991 Apps ..... 220/519
5,400,904 * 3/1995 Maston, III et al. ..... 206/725
5,415,293 * 5/1995 Ackermann et al. ..... 206/506
5,979,654 * 11/1999 Apps ..... 206/507

* cited by examiner

*Primary Examiner*—Stephen Castellano
(74) *Attorney, Agent, or Firm*—Saidman DesignLaw Group

(57) ABSTRACT

A box comprising a bottom, a pair of side walls, and a pair of end walls is stackable due to the shape of the end walls and their interaction with the bottom of the box. The end walls include parallel, upwardly directed arches flanked by flat surfaces which prevent lateral relative movement of stacked boxes. Notching the bottom to receive the end walls such that they grip the bottom prevents longitudinal relative movement of the stacked boxes.

34 Claims, 8 Drawing Sheets

STACKABLE BOXES

BACKGROUND OF THE INVENTION

1. Field of The Invention

This invention relates to stackable boxes designed to be simple in construction, inexpensive to manufacture, and yet allow ease of stacking in a stable configuration.

2. Description of Related Art

Boxes have been designed to be stackable for some time, arising from the necessity of storing or transporting a large number of boxes in a small space. A few representative examples follow:

McLean, U.S. Pat. No. 1,809,523, discloses a foldable, open top, stackable container. Hinged side walls and end walls are held in their open state by means of biasing springs 18 and leaf springs 17. In order to constrain McLean's stacked boxes against longitudinal and lateral slippage, the end walls are provided with mating tabs 19 and notches (unnumbered); the edges of the tabs of the bottom box abut the edges of the notches of the top box to prevent lateral relative movement. Shoulders 20 on the ends of the box's floor 10 abut the inner surface of bottom box's tabs 19 to prevent longitudinal sliding of the top box on the bottom box. McLean's box is complex, unstable in construction, lacks aesthetic appeal, and the interlocking structure has sharp edges which are subject to damage to themselves and others.

Cranston, U.S. Pat. No. 2,501,379, discloses a stackable display tray in which a recessed peripheral edge around the bottom of the tray fits within a complementary recessed lip interior of an identical tray's top peripheral edge. A latticework insert is shaped to fit within the tray's interior. Cranston's tray is inefficient inasmuch as the complementary recesses take up a large proportion of the interior volume of the tray, limiting its usefulness.

Voorhis, U.S. Pat. No. Des. 124,755, shows a design for stackable soap bar's having complementary, upwardly extending arches on the top and bottom surfaces, so that the convex arch of the top of the lower bar mates with the concave bottom of the upper bar. Voorhis's bars are not stable, inasmuch as there are no means provided for preventing the arcuate surfaces from sliding laterally relative to each other.

Ruff, U.S. Pat. No. 2,777,597, discloses a stackable tote box having a channel-shaped base whose end edges are welded to an end supporting member 14 which in turn is welded exteriorly thereof to end member 16 in a stepped relationship. End supporting member 14 is of an inverted V-shape; end member 16 includes parallel, V-shaped arches forming a convex peak opposite a concave notch. When stacked, the V-shaped notch of the top box mates with the V-shaped peak of the bottom box to support the top box and to prevent lateral relative movement of the boxes. The inside surfaces of the bottom box's end members 16 abut the outside surfaces of support members 14 of the top box to prevent longitudinal relative movement of the boxes. The box of Ruff is deficient in that it requires many pieces and a labor intensive assembly.

OBJECTS AND SUMMARY OF THE INVENTION

The present invention overcomes the difficulties described above by providing an aesthetically pleasing box have few parts, easy assembly, and a stable configuration when stacked on an identical box.

The present invention accomplishes the above by providing a box comprising a bottom, two side walls, and two end walls joined together by placing the bottom in a recessed groove in the side and end walls and affixing the corners of adjacent walls together. The end walls are shaped to mate easily and securely when stacked.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
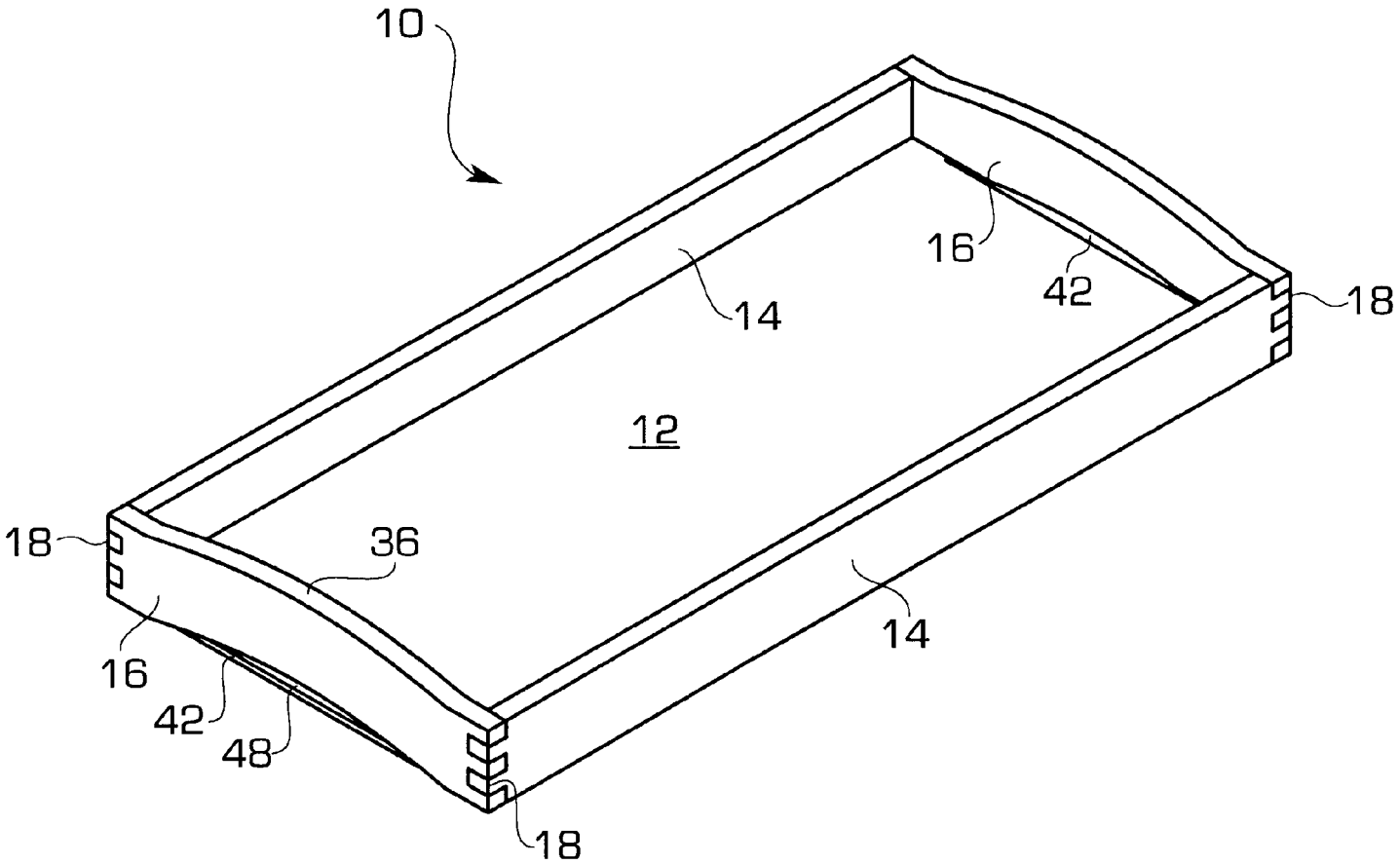
FIG. 1 is a perspective view which illustrates a preferred embodiment of the present invention.

A stackable container or stackable box 10 is shown in perspective in FIG. 1. Box 10 comprises a bottom 12, a pair of side walls 14, and a pair of end walls 16. Because of the longitudinal and transverse symmetry of box 10, side walls 14 are identical to each other and end walls 16 are identical to each other.

Figure 4:
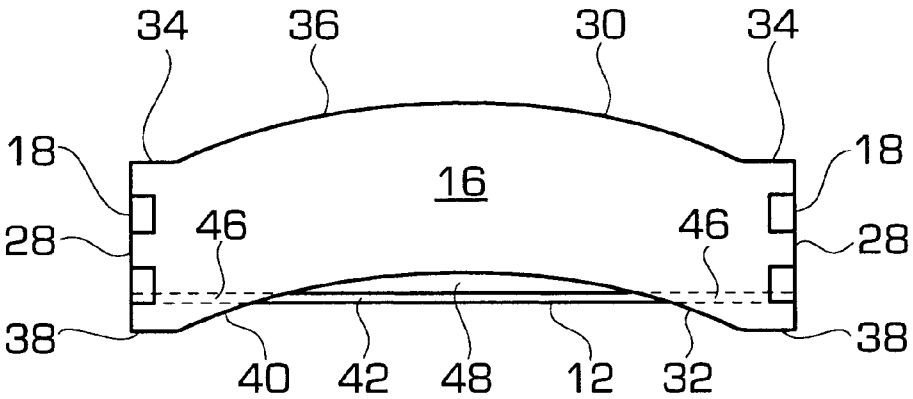
FIG. 4 is an end view of the invention of FIG. 1.
Figure 5:
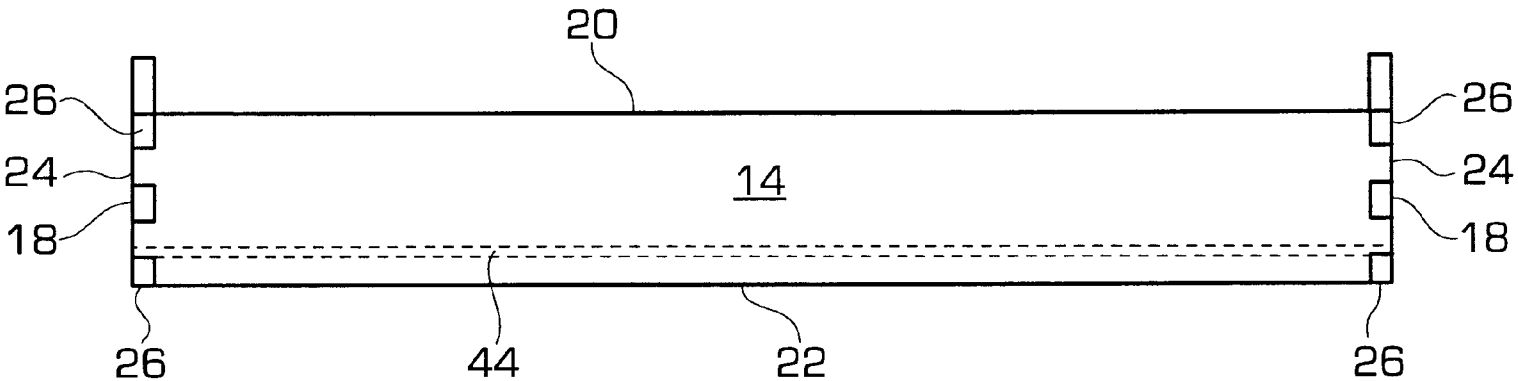
FIG. 5 is a side view of the invention of FIG. 1.

Referring to FIGS. 1, 4, and 5, side walls 14 and end walls 16 are preferably joined together by box joints 18, although any means known in the art for effectively securing them is sufficient.

Side walls 14 (FIG. 5) are preferably rectangularly shaped with a horizontal upper edge 20 parallel with a horizontal lower edge 22 joined to vertical end edges 24 at square corners 26. The particular dimensions of side walls 14 are selected dependent on the end use of box 10. For example, the organizer tray of FIG. 7 has side walls of approximately 286×41 mm; the pencil box of FIG. 8 has side walls of approximately 119×85 mm; and the file box of FIG. 9 has side walls of approximately 354×270 mm.

End walls 16 (FIG. 4) comprise opposed, linear, vertical edges 28, a top edge 30, and a bottom edge 32. Top edge 30 includes a pair of flats 34 extending inwardly from vertical ends 28 and an upwardly directed arcuate arch 36 joined at each end to one of flats 34. Bottom edge 32 includes a pair of flats 38 extending inwardly from vertical ends 28 and an upwardly directed arcuate arch 40 joined at each end to one of flats 38. Flats 34 and 38 are parallel horizontal surfaces and are all of substantially equal lengths. Arcuate arches 36 and 40 are also parallel to each other, i.e., they have the same radius of curvature, and are of substantially the same length.

In FIGS. 1 and 3–5, the periphery 42 of bottom 12 is supported by being received in linear grooves 44 formed on the interior surface of side walls 14 (FIGS. 3 and 5) and linear groove segments 46 formed on the interior surface of end walls 16 (FIGS. 3 and 4), as indicated by the dashed lines. Having periphery 42 of bottom 12 confined in grooves 44 and 46 provides stable support for bottom 12 and any contents received in box 10. If desired, periphery 42 can be adhesively fixed in grooves 44 and 46 as well.

Grooves 46 in end wall 16 appear as two segments separated by arch 40, as can be more clearly seen in FIG. 4. As a result, a portion of periphery 42 is exposed beneath arch 40. Arch 40 and periphery 42 delineate a gap 48 between bottom 12 and end wall 16. In some uses of box 10, gap 48 provides a useful function. For instance, certain produce, such as blackberries and strawberries, are placed, when picked, in shallow boxes similar to box 10. It is desirable to have air circulate through them to maintain their freshness; gaps 48 allow such circulation. Also, it is often desirable to wash fruits or produce after they have been picked. Gaps 48 allow the water to run out the bottom of the box 10, eliminating the potential problem of the fruit or produce rotting due to sitting in standing water. In other uses, for example as IN- or OUT-boxes, gaps 48 have no immediate function but nonetheless do not detract from the usefulness of box 10.

Figure 6:
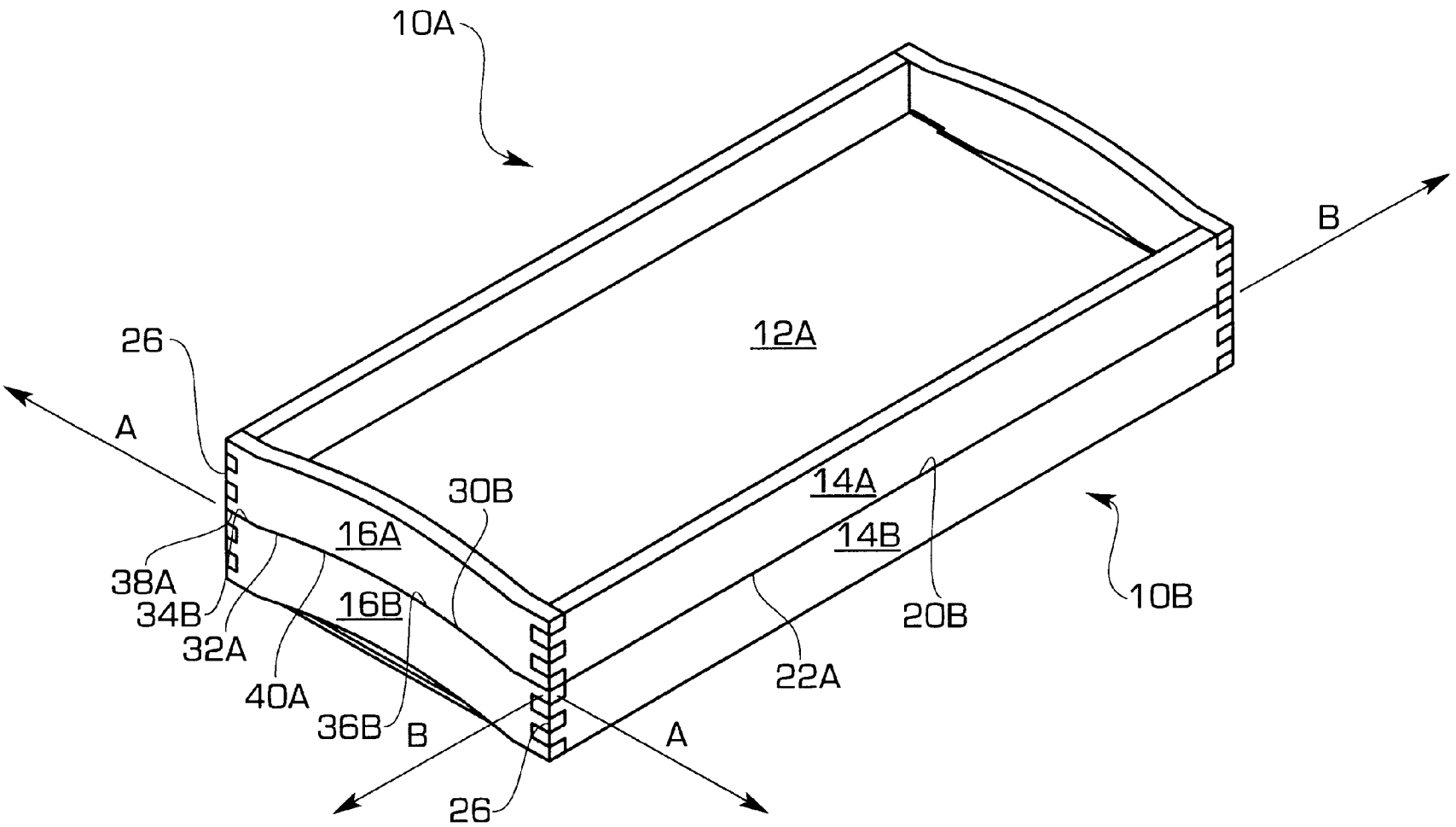
FIG. 6 is a perspective view of two of the boxes (shown in FIG. 1) stacked one on top of the other.

Referring to FIG. 6, when one box 10A is stacked on another box 10B, edge 32A of end wall 16A rests on edge 30B of end wall 16B, i.e., flats 38A of box 10A rest on flats 34B of box 10B and arch 40A of box 10A mates with arch 36B of box 10B. Arches 40A and 36B are of sufficient height and radius of curvature to prevent lateral sliding of box 10A relative to box 10B. Their curvatures, assisted by gravity, aids in guiding the boxes to fit together compactly in their proper, stable orientation. Flats 34B coact with flats 38A to constrain box 10A from rotating relative to box 10B, which could happen if arches 40A and 36B extended to or beyond corners 20. Thus, the combination of flats and arches performs three functions, namely, orienting the boxes properly, one directly above the other, preventing relative rotation of the boxes, and effectively resisting lateral, side-to-side movements (indicated by arrows A of FIG. 6) of the boxes relative to each other.

In the disclosed embodiment, edge 22A of side wall 14A rests on edge 20B to completely cover and enclose the interior of box 10B. While in some instances this is desirable, it is not a prerequisite for boxes 10. By extending end walls 16 higher (not shown) such that vertical edges 28 protrude above the top edges 20 of side walls 14, a gap can be formed between bottom edge 22A and top edge 20B, which may be important, if air circulation is desired or if access to the interior is needed.

Figure 2:
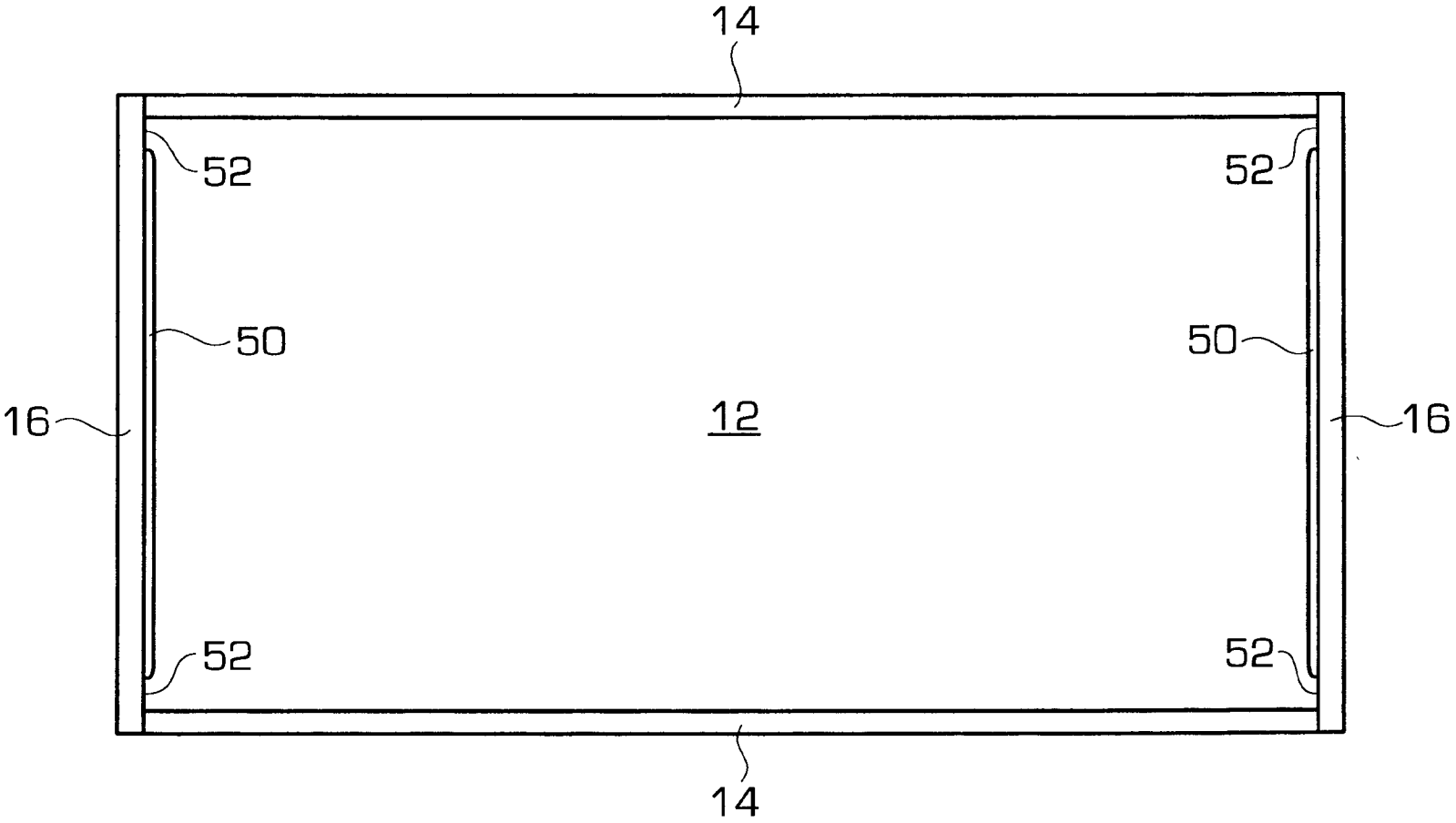
FIG. 2 is a top view of the invention of FIG. 1.
Figure 3:
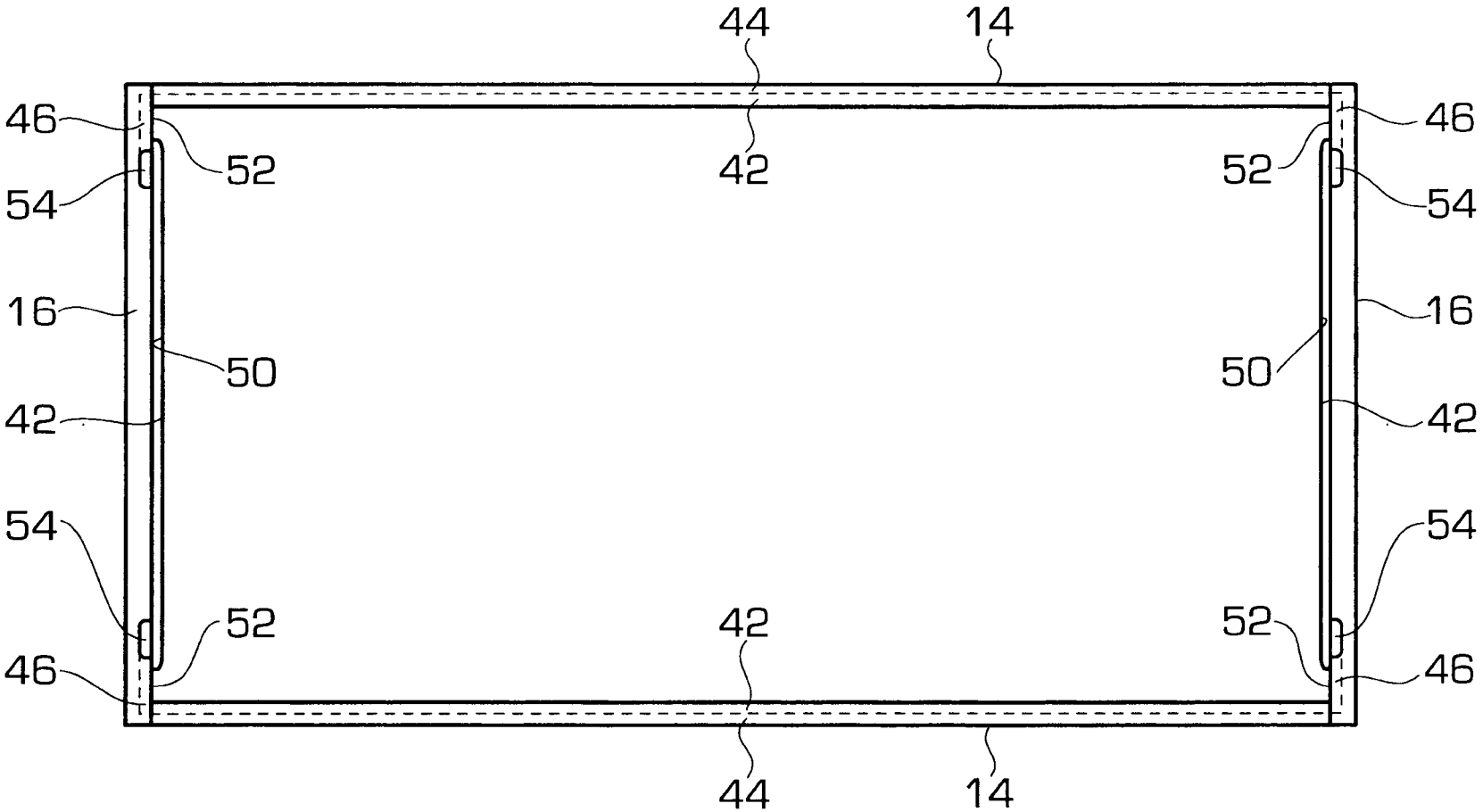
FIG. 3 is a bottom view of the invention of FIG. 1.

It will be noted that end walls 16A and 16B are coplanar, i.e., they align vertically. Such an alignment would not be possible, except for a shallow, elongated notch 50 at each end of bottom 12, as most clearly seen in FIGS. 2 and 3. Without notch 50, the periphery 42 in that area would terminate somewhere within the thickness of end wall 16, blocking the mating of arches 40A and 36B. Each of the notches 50 preferably extends slightly beyond the intersections of arch 40 with periphery 42, thereby avoiding interference with end walls 16, terminating short of end walls 16 to form tongues 52 along periphery 42. Tongues 52 are received in groove segments 46 formed in end walls 16 to support the ends of bottom 12. (As is apparent from FIGS. 3 and 4, the intersection of arch 40 with the top of groove 46 occurs closer to the center of end wall 16 than does the intersection of arch 40 with the bottom of groove 46. This structure is manifested in FIG. 3 as flat exposed surfaces 54.) Notches 50 allow both arches 36B of box 10B to bypass the exposed edges of periphery 42A at each end of box 10A and loosely grip bottom 12A therebetween. The overlap of the inside surfaces of end walls 16B with bottom 12A prevents longitudinal movement of box 10A relative to box 10B in the directions shown by arrows B in FIG. 6. It can be seen, therefore, that longitudinal and lateral movements between the two boxes is effectively prevented due to the dual arches 36 and 40 of end walls 16, an aesthetically pleasing design of an extremely simple structure which is economical to manufacture and which produces major beneficial results.

Figure 7:
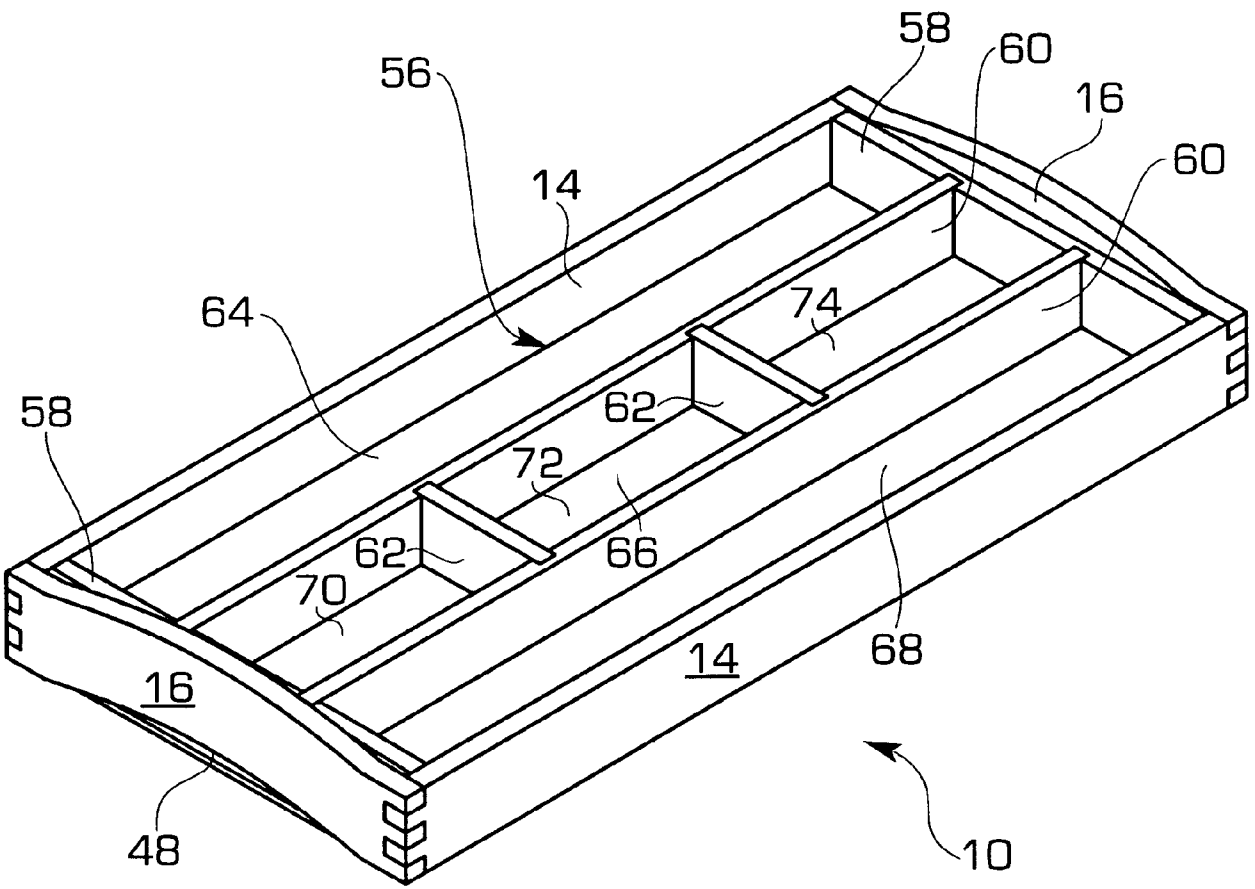
FIG. 7 illustrates a use of the present invention after receiving an insert into the interior of the inventive box.
Figure 8:
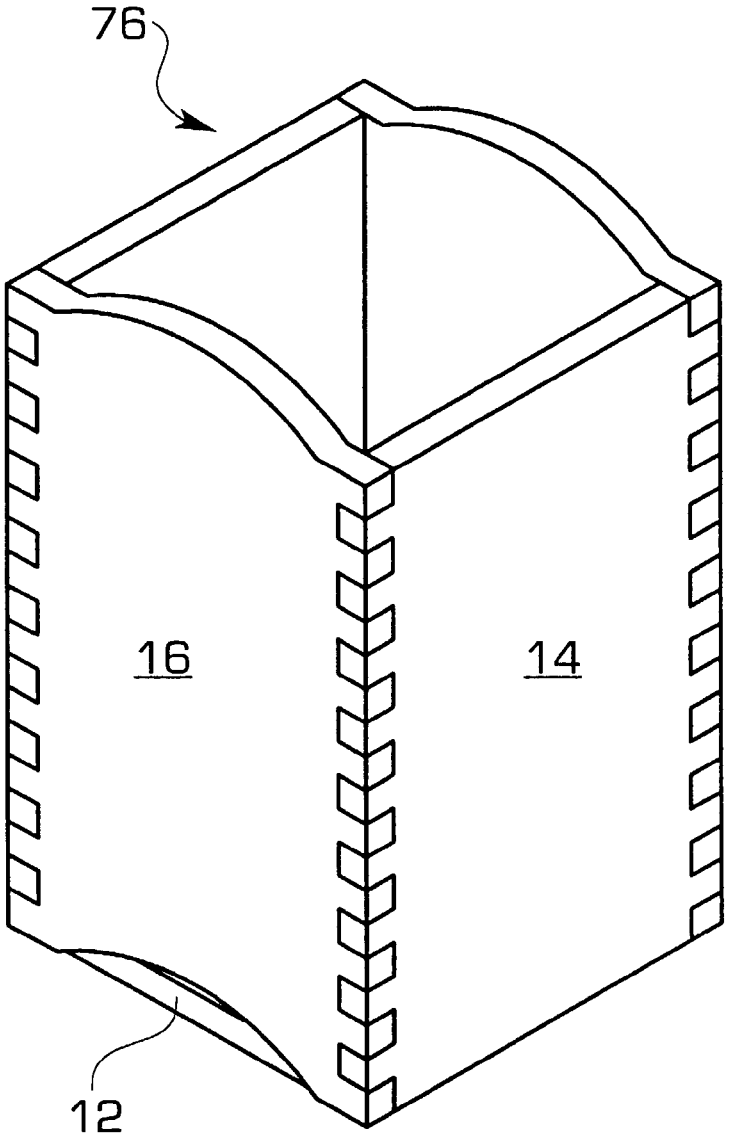
FIG. 8 shows a second embodiment of the invention.
Figure 9:
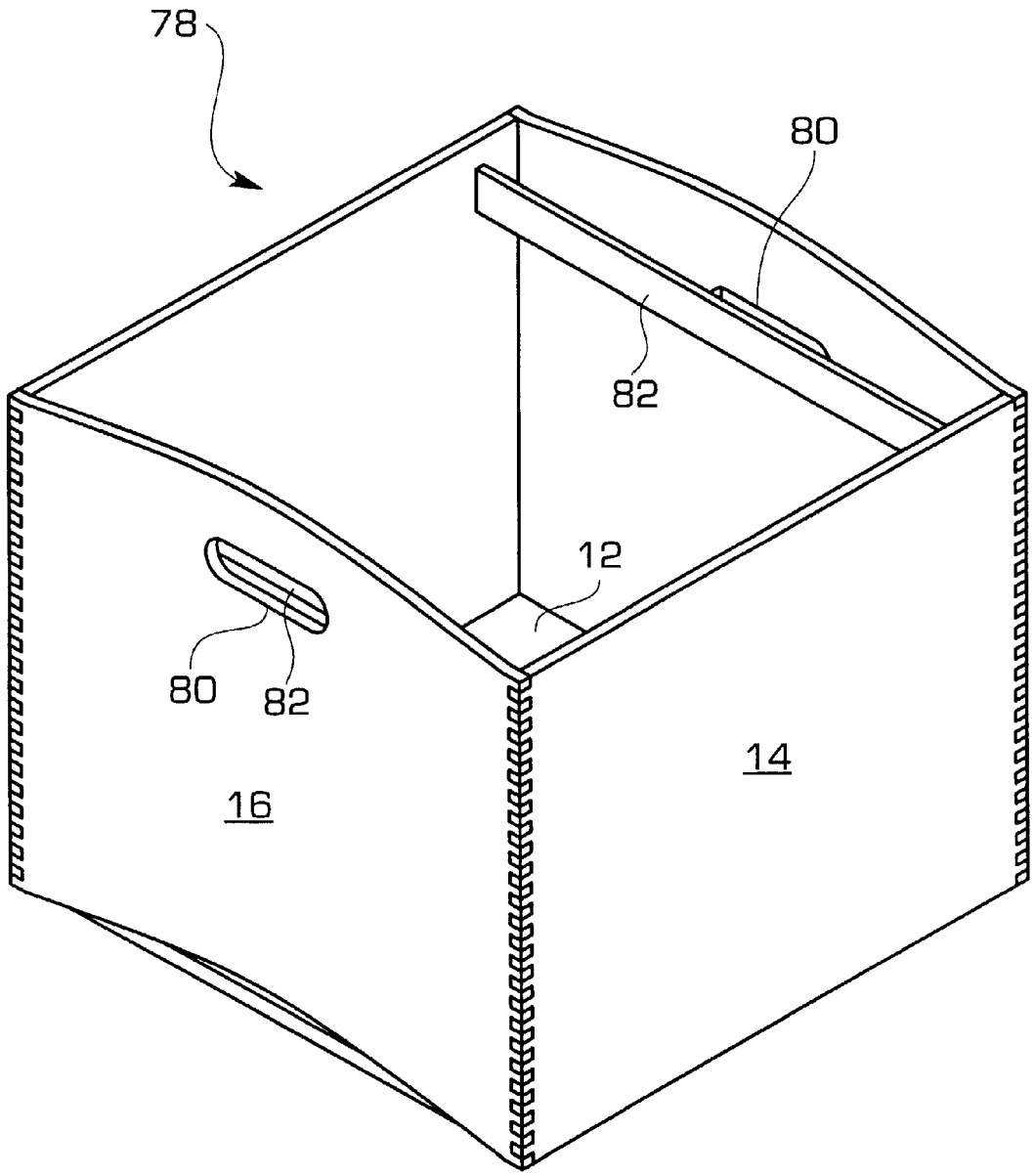
FIG. 9 shows a third embodiment of the invention.

FIGS. 7–9 show a few of the permutative possibilities of box 10.

In FIG. 7 box 10 has the same proportions as shown in FIGS. 1–6 but with a divider insert 56 placed inside. Insert 56 as shown comprises a pair of end pieces 58, longitudinal dividers 60 and transverse dividers 62, preferably joined together by tongue-and-groove connections, this being a simple, secure joining technique. In the embodiment shown, end pieces 58 fit snugly between side walls 14 and adjacent end walls 16; as such, they cover gaps 48. Longitudinal dividers 60 are fixed to end pieces 58 and run parallel to side walls 14, dividing box 10 into three, approximately equal compartments 64, 66, and 68. The middle compartment 66 is further subdivided by transverse dividers 62 into smaller compartments 70, 72, and 74. This embodiment of box 10 is suitable for use as an organizer tray for small odds-and-ends, such as sewing notions, buttons, pins, spools, etc., where the sealing of gaps 48 is desirable. As shown, box 10 could also be used as a seed box to grow young seedlings. Obviously, the latticework shown in FIG. 6 is but one of many which could be implemented. All variations are considered to be within the purview of the invention.

FIG. 8 displays a pencil holder 76 for use with a desk set. Preferably, side walls 14 and end walls 16 have the same lateral dimensions, making bottom 12 square, and all of the walls are made taller than the previous embodiment. While the pencil holder 76 is not intended to be stacked (although it certainly could be), it is an example of how the aesthetic qualities of the smooth, simple lines of basic box 10 can be taken advantage of to design an elegantly styled office accessory.

With a few additions, basic box 10 becomes a file box 78 (FIG. 9) for hanging files. Side walls 14 and end walls 16 are again proportioned for the intended use. Hand holds 80 are formed in end walls 16 and a pair of transverse file support bars 82 (only one shown) are affixed to side walls 14 adjacent and parallel to both end walls 16, respectively. The result is a stackable file box 78. Of course, hand holds 80 could as easily be formed in side walls 14, and support bars 82 could be affixed to end walls 16; the embodiment shown is merely for illustration. Also, the length of side walls 14 would be selected to accommodate legal- or letter-sized files.

It is clear from the above that the objects of the invention have been fulfilled. An open-topped, stackable box has been disclosed which is aesthetically pleasing in appearance, simple in construction, economical to manufacture, and easy to stack and store.

Those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It is to be understood, therefore, that the disclosure is by way of illustration only and that the scope of the invention is to be limited solely by the following claims:

We claim as our invention:

1. A stackable box, comprising:

a bottom, a side wall having a top edge and bottom edge, and a pair of end walls;

said side wall being joined to said end walls, and said bottom being joined to said side wall and said end walls, each of said end walls comprising a top edge, a bottom edge and a pair of side edges, said top and bottom edges of said end walls including respective top and bottom, upwardly extending, continuously radiused arcs flanked by a respective pair of horizontal flats, each of said flats being located between one end of its associated upwardly extending arc and one of said side edges of said end walls and immediately adjacent to its associated upwardly extending arc, whereby when similar stackable boxes are stacked one on top of the other, said top edges of said end walls of the bottom box will mate with said bottom edges of said end walls of the top box, preventing relative lateral movement of said boxes, and said end walls constrain said boxes against relative longitudinal movement.

2. The stackable box of claim 1, wherein said side wall is joined to said end walls by means of box joints.

3. The stackable box of claim 1, wherein said bottom is joined to said side wall and said end walls by means of the periphery of said bottom being received in a groove in each of said side wall and said end walls.

4. The stackable box of claim 1, wherein said bottom arcs of said end walls extend upwardly sufficiently to delineate gaps between said bottom edges of said end walls and said ends of said bottom.

5. The stackable box of claim 1, wherein said flats on said top and bottom edges of each of said end walls are parallel to each other and are of substantially equal lengths.

6. The stackable box of claim 5, wherein said top and bottom arcs of each of said end walls are substantially parallel to each other, have substantially the same radius of curvature, and are of substantially equal lengths.

7. The stackable box of claim 1, wherein the opposite ends of said side wall each include a side edge, said side edges of said side wall being joined to said side edges of said end walls, and said side edges of said side walls and said side edges of said end walls are all of substantially the same height.

8. The stackable box of claim 7, wherein said side wall, said end walls, and said bottom are dimensioned to form a flat, shallow tray.

9. The stackable box of claim 7, wherein said top and bottom edges of said side wall are horizontal.

10. The stackable box of claim 9, wherein said side edges of said side wall and said side edges of said end walls are vertical.

11. The stackable box of claim 10, wherein said flats are substantially parallel to said top and bottom edges of said side wall.

12. The stackable box of claim 1, wherein each of said side walls includes a horizontal top edge and a horizontal bottom edge and vertical ends, said flats being substantially parallel to said top and bottom edges of said side walls.

13. The stackable box of claim 1, wherein said flats and said top edges of said side wall are co-planar.

14. The stackable box of claim 1, wherein said top and bottom edges of each of said end walls are substantially parallel to each other.

15. The stackable box of claim 1, further comprising a pair of side walls, each of said side walls including a top edge and a bottom edge.

16. The stackable box of claim 15, wherein said flats and said top edges of said side walls are co-planar.

17. The stackable box of claim 15, wherein said side walls, said end walls, and said bottom are dimensioned to form a pencil box.

18. The stackable box of claim 15, wherein said side walls, said end walls, and said bottom are dimensioned to form a file holder.

19. A stackable box, comprising:

a bottom, a pair of side walls, and a pair of end walls;

said side walls being joined to said end walls, and said bottom being joined to said side and end walls, each of said end walls comprising a top edge and bottom edge which are substantially parallel to each other, said top and bottom edges including respective top and bottom, upwardly extending arches flanked by a respective pair of flats, each of said flats being located between one end of its associated upwardly extending arch and one of said vertical ends of said end walls, whereby when similar stackable boxes are stacked one on top of the other, said top edges of said end walls of the bottom box will mate with the bottom edges of said end walls of the top box, preventing relative lateral movement of said boxes, and said end walls will loosely grip the ends of said bottom, constraining said boxes against relative longitudinal movement;

wherein said bottom arches of said end walls extend upwardly sufficiently to delineate gaps between said bottom edges of said end walls and said ends of said bottom;

wherein said ends of said bottom include centrally located notches, the ends of said notches terminating outboard of said gaps, such that said ends of said bottom include tongues which are received in grooves in the interior surface of said end walls.

20. The stackable box of claim 19 in combination with an insert adapted for placement within the interior of said stackable box, said insert comprising a pair of end pieces joined together by a plurality of dividers which divide said interior into separate compartments, said insert being dimensioned such that said end pieces close said gaps.

21. The stackable box of claim 20, wherein said end pieces and dividers are joined together by means of tongue-and-groove connections.

22. An apparatus, comprising:

a first box and a second box, each of said boxes comprising:

a bottom, a first side wall having top and bottom edges, and an opposing pair of end walls, each having top and bottom edges;

said first side wall being joined to said end walls, and said bottom being joined to said first side wall and said end walls; and said top and bottom edges of said end walls each including an upwardly extending arched portion flanked by a pair of flats;

wherein when said first box is stacked atop said second box, said top edges of said end walls of said second box mate with said bottom edges of said end walls of said first box, thereby preventing relative lateral movement of said boxes, and said end walls of said second box constrain said boxes against relative longitudinal movement;

wherein said top edge of said side wall said flaps associated with said top edges of said end wall extending in a single, horizontal plane.

23. The apparatus of claim 22, wherein said first and second boxes each comprise a second side wall, said second side wall opposing said first side wall.

24. The apparatus of claim 23, wherein said second side wall includes horizontal top and bottom edges.

25. The apparatus claim 22, wherein said first side wall is joined to said end walls by means of box joints.

26. The apparatus claim 22, wherein said bottom is joined to said first side wall and said end walls by means of the periphery of said bottom being received in a groove in said first side wall and each of said end walls.

27. The apparatus of claim 22, wherein said arched portions of said bottom edges of said end walls extend upwardly sufficiently to delineate gaps between said bottom edges of said end walls and said ends of said bottom.

28. The apparatus claim 27, wherein said ends of said bottom include centrally located notches, the ends of said notches terminating outboard of said gaps, such that said ends of said bottom include tongues which are received in grooves in the interior surface of said end walls.

29. The apparatus claim 22, wherein the opposite ends of said first side wall include vertical edges and the opposite ends said end walls include vertical edges, said side wall's vertical edges being joined to said end walls' vertical edges, and said vertical edges of said first side wall and said vertical edges of said end walls are all of substantially the same height.

30. The apparatus claim 22, wherein the opposite ends of said first side wall each include a side edge, said side edges of said first side wall being joined to said side edges of said end walls, and said side edges of said first side wall and said side edges of said end walls are all of substantially the same height.

31. The apparatus of claim 22, wherein said bottom edge of said first side wall of said first box rests upon said top edge of said first side wall of said second box when said first box is stacked atop said second box.

32. The apparatus of claim 22, wherein said arched portions of said top and bottom edges of said end walls are parallel to each other, have substantially the same radii of curvature and are of substantially equal lengths.

33. The apparatus of claim 22, wherein when said first box is stacked atop said second box said end walls of said second box loosely grip the ends of said bottom of said first box.

34. A stackable box, comprising:

a bottom, a pair of side walls, and a pair of end walls;

said side walls being joined to said end walls, and said bottom being joined to said side and end walls, each of said end walls comprising a top edge and bottom edge which are substantially parallel to each other, said top and bottom edges including respective top and bottom, upwardly extending arcs flanked by a respective pair of flats, each of said flats being located between one end of its associated upwardly extending arc and one of said vertical ends of said end walls, whereby when similar stackable boxes are stacked one on top of the other, said top edges of said end walls of the bottom box will mate with the bottom edges of said end walls of the top box, preventing relative lateral movement of said boxes, and said end walls will loosely grip the ends of said bottom, constraining said boxes against relative longitudinal movement;

wherein each of said side walls includes a horizontal top edge and a horizontal bottom edge and vertical ends, said flats being substantially parallel to said top and bottom edges of said side walls;

wherein the opposite ends of said side walls include vertical ends and the opposite ends said end walls include vertical ends, said side walls' vertical ends being joined to said end walls' vertical ends, and said vertical ends of said side walls and said vertical ends of said end walls are all of substantially the same height;

wherein said side walls, said end walls, and said bottom are dimensioned to form a file holder; and hand holes formed in opposite walls of one of said side walls and said end walls and a pair of transverse file support bars affixed to the other of said side walls and said end walls.

* * * * *